US005662153A

United States Patent [19]

Rosenblatt

[11] Patent Number: 5,662,153

[45] Date of Patent: Sep. 2, 1997

[54] SEMI-CIRCULAR WINDOW SHADE

[76] Inventor: Milton L. Rosenblatt, 636 Torrey Pines Rd., Banning, Calif. 92220

[21] Appl. No.: 681,846

[22] Filed: Jul. 29, 1996

[51] Int. Cl.[6] ..... E06B 9/06

[52] U.S. Cl. ..... 160/84.07; 160/134

[58] Field of Search ..... 160/84.07, 134, 160/330, 368.1, 279, 38, 39

[56] References Cited

U.S. PATENT DOCUMENTS

| | | | |
|---|---|---|---|
| 1,609,877 | 12/1926 | Kendall | 160/134 X |
| 4,934,434 | 6/1990 | Schnebly | 160/84.1 |
| 4,934,436 | 6/1990 | Schnebly | 160/84.1 |
| 5,002,112 | 3/1991 | Schnebly | 160/84.1 |
| 5,050,661 | 9/1991 | Sikkema | 160/84.1 |
| 5,139,070 | 8/1992 | Kidd | 160/84.1 |
| 5,159,966 | 11/1992 | Fleishman | 160/84.1 |
| 5,168,912 | 12/1992 | Jelic | 160/84.1 |
| 5,183,092 | 2/1993 | Jelic | 160/84.1 |

*Primary Examiner*—David M. Purol

*Attorney, Agent, or Firm*—Gene Scott - Patent Law & Venture Group

[57] ABSTRACT

A frame supports a fan-shaped pleated shade that is rotated from a folded open position to an unfolded closed position so that the shade covers a semi-circular window adjacent to the shade. Two pull-cords are attached to the shade to rotate it between its two extreme positions. The cords are routed over circular surfaces so that they apply a normal force to the shade throughout its movement.

5 Claims, 4 Drawing Sheets

SEMI-CIRCULAR WINDOW SHADE

BACKGROUND OF THE INVENTION

1. Field of the Invention

This invention relates generally to a retractable window shade, and more particularly to a fan-type shade for a semi-circular window.

2. Description of the Related Art

The following art defines the present state of this field:

Jelic et al, U.S. Pat. No. 5,168,912 and U.S. Pat. No. 5,183,092 teaches arch window blinds rotatable by the use of a pair of cords attached at the extreme lateral ends of the shade. Sikkema et al, U.S. Pat. No. 5,050,661 teaches a blind for rounded windows in which the operating cords drive a control arm. Schnebly et al, U.S. Pat. No. 4,934,436, U.S. Pat. No. 4,934,434 and U.S. Pat. No. 5,002,112, teaches shading devices for a curved window in two embodiments; the first being a translational deployment moving the shade from its compressed state, upward to cover some or all of the window, the second being a rotational scheme, for a fan type shade. Kidd, U.S. Pat. No. 5,139,070 teaches a split design for a rotational fan type shade. Fleishman et al, U.S. Pat. No. 5,159,966 teaches a rather complex fan type blind for an arched window.

The prior art teaches the use of fan-type shades or blinds for curved windows. However, the operating structures of the prior art devices are relatively complex resulting in high initial cost and potential maintenance problems. The prior art also fails to teach a simple, cord pull system devised to operate the shade with relatively little cord pulling as well as little effort. The present invention fulfills these needs in an optimal manner and provides further related advantages as described in the following summary.

SUMMARY OF THE INVENTION

The present invention teaches certain benefits in construction and use which give rise to the objectives described below. A frame supports a fan-shaped pleated shade that is rotated from a folded open position to an unfolded closed position whereby the shade covers a window adjacent to the shade. Two pull-cords are attached to the shade to rotate it between its two extreme positions. The cords are routed over circular surfaces so that they apply a normal force to the shade throughout its movement. Therefore, an object of the present invention is to provide an improved shade for a semi-circular window. A further object of the invention is to provide such a shade having a simplified cord actuated operating mechanism. A still farther object is to provide such an operating mechanism whereby the operating force required to move the shade between the open and closed positions is minimal, while the amount of cord pulling required is also minimal. A final object of the invention is to provide such a cord pulling operating mechanism, whereby in-feed and out-feed portions of the operating cord are both positioned on the same side of the device.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a manufactured device. In such drawings.

DETAILED DESCRIPTION OF THE PREFERRED EMBODIMENT

Figure 1:
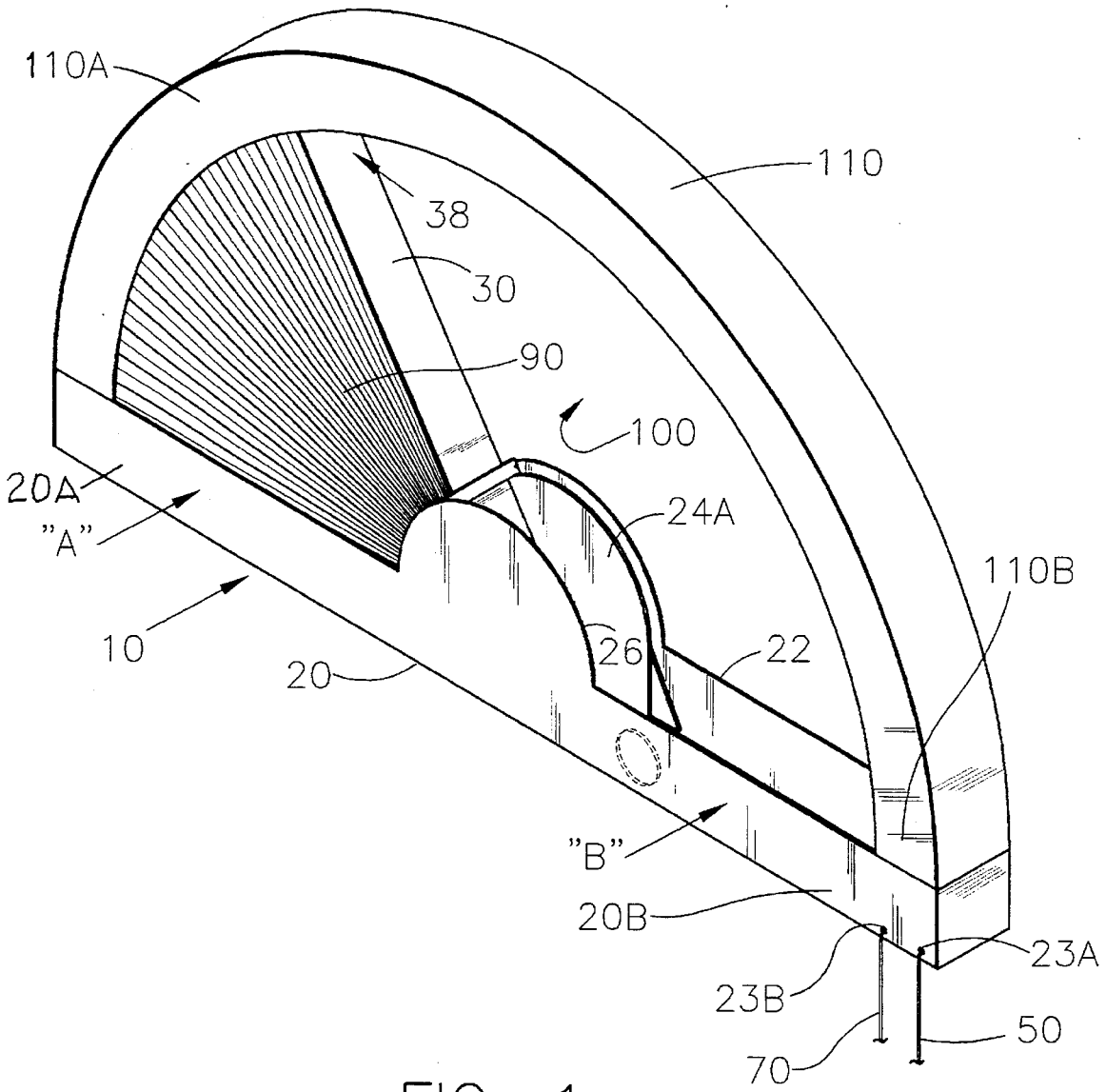
FIG. 1 is a perspective view of a preferred embodiment of the present invention showing a shade of the device in a partially open position.
Figure 2:
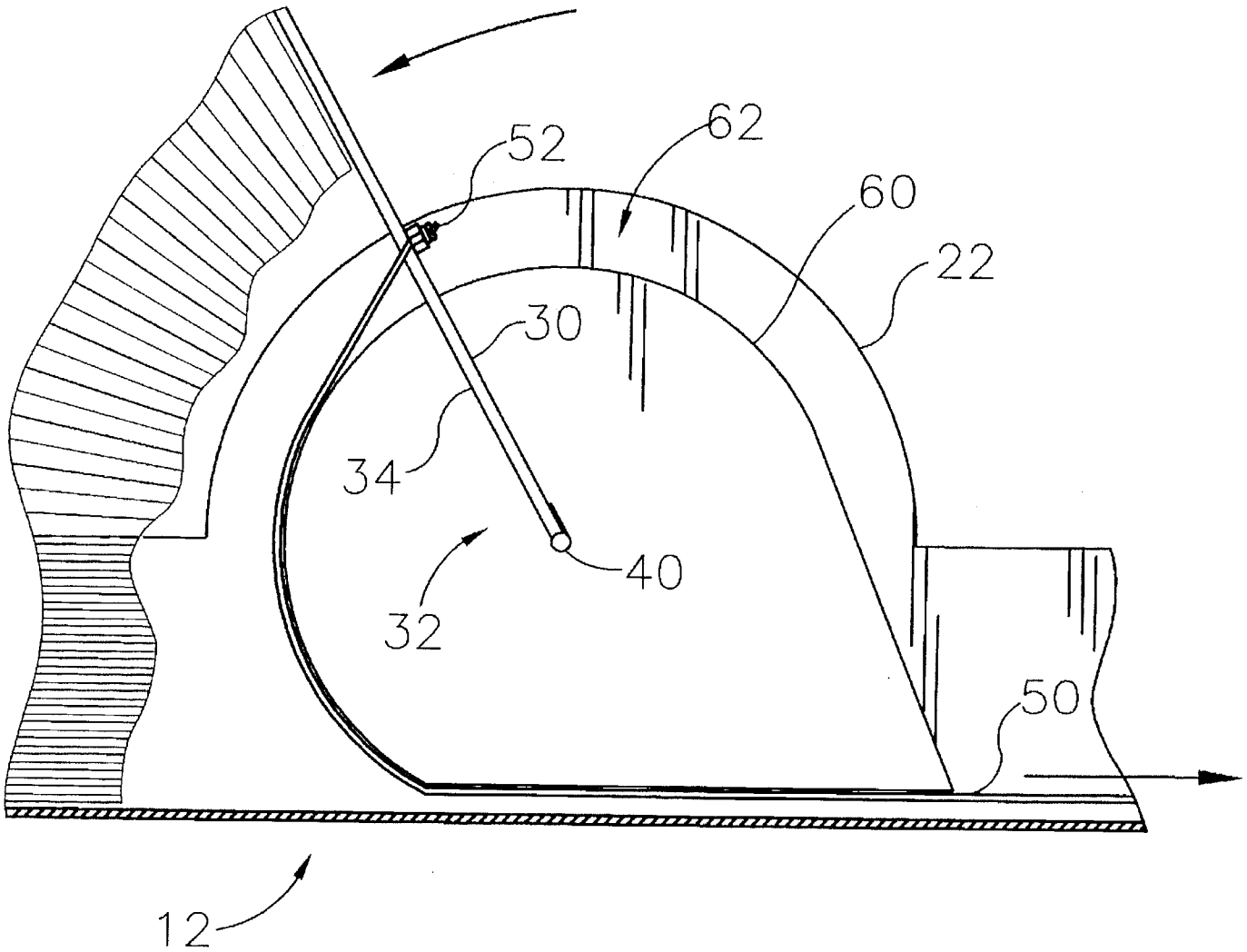
FIG. 2 is a partial front elevational view thereof, shown with a lower front vertical wall removed to expose the cord operating detail of the invention.
Figure 3:
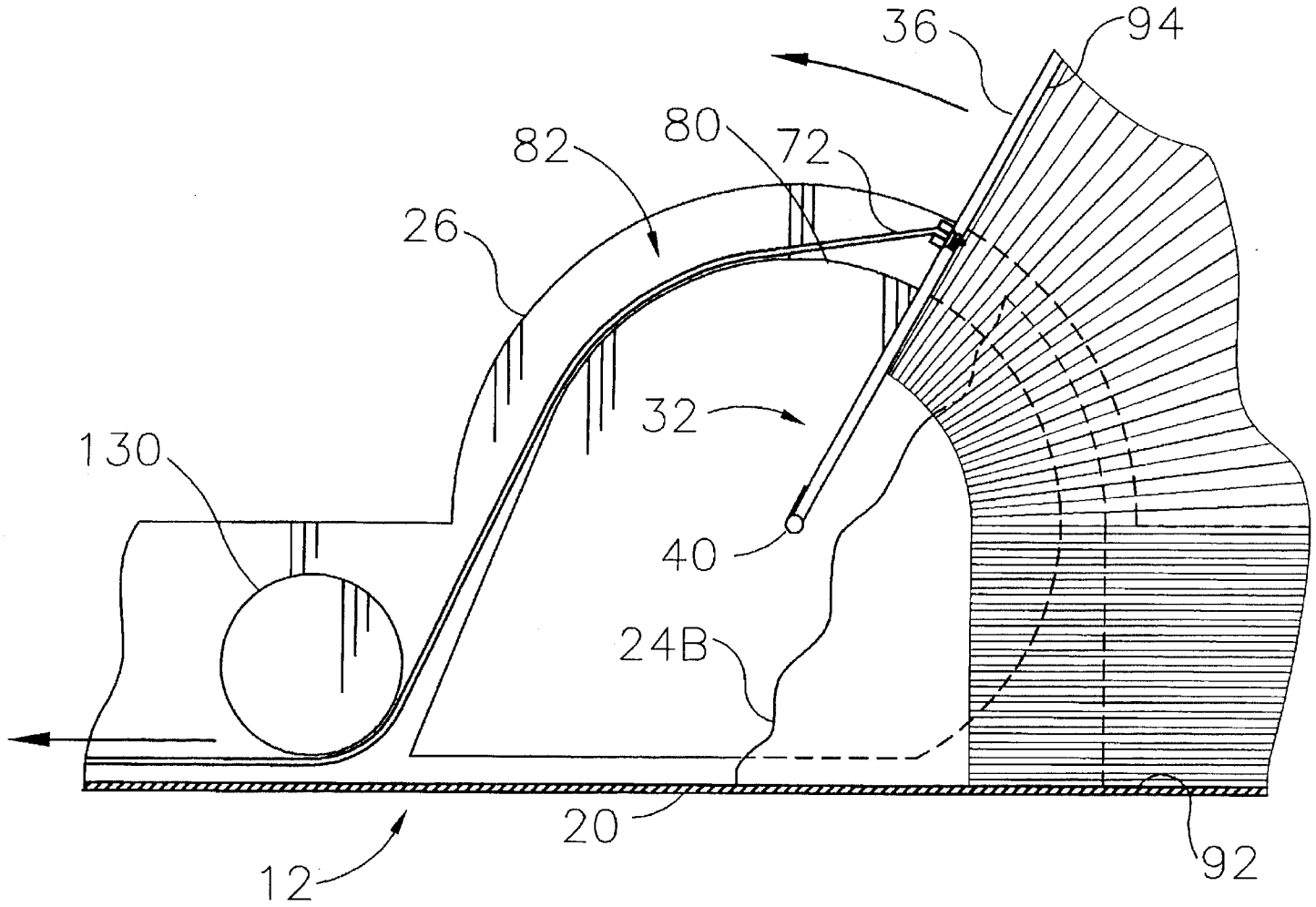
FIG. 3 is a partial rear elevational view thereof, shown with a lower rear vertical wall removed to expose further cord operating detail of the invention.

The above described drawing figures illustrate the invention, a window shading device comprising a frame 10 having a horizontal member 20 with a downfacing surface 12 for resting the device on a window sill or similar horizontal surface (not shown) adjacent to a window to be shaded. A rigid operating slat 30 is engaged, mechanically, by an adhesive, or any other attachment means, at a proximal end 32 thereof, by a pivot pin 40 held in the horizontal member 20, thereby enabling the rigid operating slat 30 to rotate, preferably at the center of the horizontal member 20 so that the rigid operating slat 30 is free to swing through a vertical arc. Therefore the rigid operating slat 30 moves from a position laying preferably approximately parallel to the horizontal member 20 on one side "A" of the pivot pin 40, around to an alternate position laying preferably approximately parallel to the horizontal member 20 on the other side "B" of the pivot pin 40.

A first cord 50, having one end 52 thereof fixed, by a knot or other fastening means, to the rigid operating slat 30, extends from the rigid operating slat 30 around a first fixed arced surface 60. The first surface 60 provides a first contour 62, preferable circular in shape, so that a tension in the first cord 50 provides a force, away from, and approximately normal to one side 34 of the rigid operating slat 30 throughout said swing when the first cord 50 is pulled to draw the device open so that light may move through the shading device. The first cord 50 is sandwiched between a rear sidewall 22 and an interior partition 24A so that it is constrained to move on the first surface 60. The cord 50 moves from the surface 60 to an access hole 23A in the horizontal member 20, as shown in FIG. 1.

A second cord 70, having one end 72 thereof also fixed to the rigid operating slat 30, extends from the rigid operating slat 30 around a second fixed arced surface 80, the second surface 80 providing a second contour 82, preferably also circular in shape, so that a tension in the second cord 70 provides a force, away from, and approximately normal to the other side 36 of the rigid operating slat 30 throughout said swing when the second cord 70 is pulled to draw the device closed so that light may be blocked from moving through the shading device. The second cord 70 is sandwiched between a front sidewall 26 and another interior partition 24B so that it is constrained to move on the second surface 80. The cord 70 moves from the surface 80 to another access hole 23B preferably adjacent to the hole 23A, in the horizontal member 20, as shown in FIG. 1. A guide surface 130 is positioned on the from wall 26 so as to guide the second cord 70 around the surface 80.

A means for shading 90 has one edge 92 thereof fixed to the horizontal member 20 on the one side "A" of the pivot pin 40, and an opposing edge 94 thereof fixed to the rigid operating slat 30. The means for shading 90 rests in a closed and folded state when the rigid operating slat 30 is rotated so as to be positioned on the one side "A" of the pivot pin 40, and extends into an unfolded state to cover a semicircular area 100 above the horizontal member 20 when the rigid operating slat 30 is rotated so as to be positioned on the other side "B" of the pivot pin 40.

The device may further include a semi-circular rigid member 110 extending above the horizontal member 20. The ends 110A, 110B of the semi-circular member 110 join the ends 20A, 20B of the horizontal member 20 to complete a closed figure defining the area 100. A distal end 38 of the rigid operating slat 30 lies adjacent to the semi-circular member 110 throughout said swing.

Preferably, the horizontal member 20 and the semi-circular member 110 are U-shaped in cross section. The means for shading 90 covers the area 100 when the means for shading 90 is in the unfolded state and uncovers the area 100 when in the closed or folded state.

Figure 4:
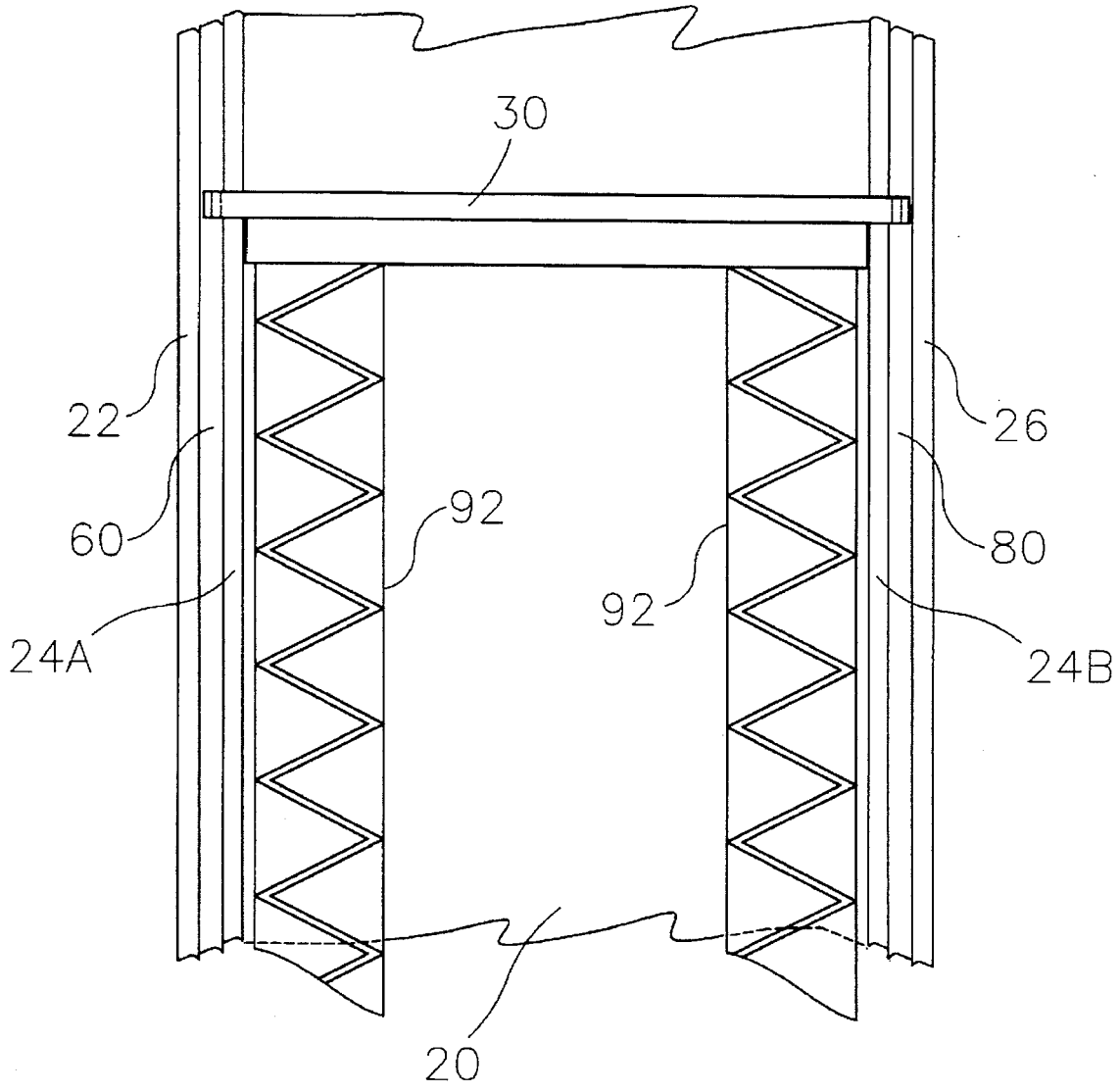
FIG. 4 is a partial top plan view thereof, shown with a semi-circular top rigid member removed to expose a preferred interior construction detail of the fan, the cords and attachment means for the cords being deleted from this view for clarity.

The means for shading 90 is preferably made up of a pair of side-by-side pleated fabrics 92, as shown best in FIG. 4, but may also comprise a single pleated fabric 92. Other means for folding, sliding, or expanding may be used in place of a pleated fabric within the scope and meaning of the invention.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A window shading device comprising:

a frame having a horizontal member with a downfacing surface for resting the device on a window sill;

a rigid operating slat engaged at a proximal end thereof, by a pivot pin supported in the horizontal member for holding the rigid operating slat for rotation in the horizontal member so that the rigid operating slat is free to swing through a vertical arc, about the pivot pin;

a first cord having one end thereof fixed to the rigid operating slat, the cord extending from the rigid operating slat around a first fixed surface, the first surface providing a first contour so that a tension in the first cord provides a force, away from, and approximately normal to one side of the rigid operating slat throughout said swing when the first cord is pulled;

a second cord having one end thereof fixed to the rigid operating slat, the second cord extending from the rigid operating slat around a second fixed arced surface, the second surface providing a second contour so that a tension in the second cord provides a force, away from, and approximately normal to the other side of the rigid operating slat throughout said swing when the second cord is pulled;

a foldable means for shading having one edge thereof fixed to the horizontal member on the one side of the pivot pin, and an opposing edge thereof fixed to the rigid operating slat, the means for shading resting in a closed and folded state when the rigid operating slat is positioned on one side of the pivot pin, and extending into an open state to cover a semicircular area above the horizontal member when the rigid operating slat is positioned on the other side of the pivot pin.

2. The device of claim 1 further including a semi-circular rigid member extending above the horizontal member, the ends of the semi-circular member joining the ends of the horizontal member to complete a closed figure defining an opening therein, a distal end of the rigid operating slat laying adjacent to the semi-circular member throughout said swing.

3. The device of claim 2 wherein the horizontal member and the semi-circular member are U-shaped in cross section the means for shading covering the opening in the closed figure when the means for shading is in the open state.

4. The device of claim 1 wherein the means for shading comprises a pair of side-by-side pleated fabrics.

5. The device of claim 4 wherein the means for shading comprises a single pleated fabric.

* * * * *